US007178438B2

(12) United States Patent
Xin et al.

(10) Patent No.: US 7,178,438 B2
(45) Date of Patent: Feb. 20, 2007

(54) POWER MITER SAW

(75) Inventors: Wang Xin, Pingjiang District of Suzhou (CN); Liu Changning, Suzhou (CN); Kong Zhao, Suzhou (CN)

(73) Assignee: Positec Power Tools (Suzhou) Co., Ltd. (CN)

( * ) Notice: Subject to any disclaimer, the term of this patent is extended or adjusted under 35 U.S.C. 154(b) by 153 days.

(21) Appl. No.: 10/879,376

(22) Filed: Jun. 28, 2004

(65) Prior Publication Data

US 2005/0005752 A1 Jan. 13, 2005

(30) Foreign Application Priority Data

Jun. 30, 2003 (CN) ..... 03 2 59269

(51) Int. Cl.
*B27B 5/00* (2006.01)
*B26D 1/18* (2006.01)
*B26D 5/08* (2006.01)

(52) U.S. Cl. ..... 83/397; 83/471.3; 83/473; 83/478; 83/490; 83/581

(58) Field of Classification Search ..... 83/581, 83/397, 473, 490, 478, 471.3
See application file for complete search history.

(56) References Cited

U.S. PATENT DOCUMENTS 4,805,504 A * 2/1989 Fushiya et al. ..... 83/397

* cited by examiner

*Primary Examiner*—Kenneth E. Peterson
*Assistant Examiner*—Isaac Hamilton
(74) *Attorney, Agent, or Firm*—Fulwider Patton LLP

(57) ABSTRACT

The present invention relates to a power miter saw with a quick actuating mechanism for a movable guard. The mechanism comprises a mounting arm, a fixed guard, a drive means and a circular saw blade. A movable guard is pivotally connected to the fixed guard. The movable guard is pivotally connected to the front end of the actuating link by a second guiding member. The rear end of the actuating link is movably connected to the mounting arm. A first guiding member is disposed on the rear end of the actuating link and the mounting arm has a first arcuate slide slot with which the first guiding member engages. When the fixed guard moves together with the saw unit downwardly, the actuating link pivotally engages the first slide slot and actuates the movable guard rapidly to open. The movable guard of the present invention can be easily manufactured and conveniently assembled or adjusted so as to reduce the cost.

8 Claims, 5 Drawing Sheets

POWER MITER SAW

TECHNICAL FIELD

The present invention relates to a power miter saw comprising a quick actuating mechanism for a movable guard.

BACKGROUND INFORMATION

U.S. Pat. No. 4,805,504 discloses a quick actuating mechanism for the movable guard of a power miter saw which at two ends of an actuating link has cam grooves. However the cam grooves are difficult to manufacture and the curvature is difficult to control. EP-A-0407204 discloses an arcuate slide slot mechanism and the guiding member which causes the sliding movement of the movable guard is fixed on the safety guard so that it is complex to assemble and inconveniently adjustable whilst demanding highly precise mounting. U.S. Pat. No. 5,203,245 discloses an assembly which comprises a slide slot in an actuating link and a link control bearing in a fixed guard. This construction is difficult to manufacture and has a complex slide slot.

SUMMARY OF THE INVENTION

It is an object of the invention to provide a straightforwardly constructed and rapidly actuable actuating mechanism for the movable guard of a power miter saw. More particularly the present invention relates to a power miter saw with a rotatable saw unit which exploits a series of guide couplings to expose a circular saw blade for cutting by opening a movable guard in response to movement of the rotatable saw unit from an upper (at rest) position to a lower (operational or full cut) position.

In accordance with the invention, a power miter saw comprises a support base and a mounting arm connected to the support base. A fixed guard is pivotally connected to the mounting arm by a rotating shaft. A circular saw blade is fixedly connected to the output rotating shaft of a drive means. A movable guard is rotatably connected to the fixed guard by a rotating shaft. The movable guard is pivotally connected to a front end of an actuating link. A member may be connected to the mounting arm and a first curved slide slot formed in the member. A third guiding member is connected to the member. A first guiding member is disposed on the rear end of the actuating link and a third slide slot is formed on the rear end of the actuating link. The rear end of the actuating link is movably connected to the member by the first guiding member engaging the first curved slide slot and the third guiding member engaging the third slide slot.

In a preferred embodiment, the guided movement is such that the movable guard moves substantially radially outwardly.

When the fixed guard is pressed downward by the operator, the actuating link rapdily opens the movable guard. The present invention can be easily manufactured and conveniently assembled or adjusted so as to reduce cost.

Typically the mounting arm is substantially vertically connected to the support base. The actuating link is generally curved.

Preferably the first guide coupling guides the rear end of the actuating link in an arcuate direction relative to the mounting arm in response to movement of the fixed guard from the upper at rest position to the lower cutting position such that the movable guard moves substantially radially outwardly. Preferably the third guide coupling guides the rear end of the actuating link in a direction relative to the mounting arm which is substantially along its longitudinal axis in response to movement of the fixed guard from the upper at rest position to the lower cutting position such that the movable guard moves substantially radially outwardly.

The first and third guide couplings between the rear end of the actuating link and the mounting arm may be direct or indirect couplings. Preferably the power miter saw further comprises a member secured to the mounting arm. Typically the member is a plate member secured to the mounting arm by conventional fasteners.

In a preferred embodiment, the power miter saw further comprises:

a member connected to the mounting arm, wherein the first guide coupling comprises:

a first guiding member disposed on the rear end of the actuating link and a first curved slide slot formed in the member and wherein the third guide coupling comprises:

a third guiding member connected to the member and a third slide slot formed in the rear end of the actuating link, whereby the movement of the rear end of the actuating link relative to the mounting arm is guided by the first guiding member engaging the first curved slide slot and the third guiding member engaging the third slide slot. The curved shape of the first curved slide slot may be any curved profile which enables the movable guard to move substantially radially outwardly. The third slide slot is substantially coaxial with the longitudinal axis of the actuating link.

Preferably a second slide slot is formed in the front end of the actuating link and extends in a substantially longitudinal direction therealong, wherein a second guiding member engages the second slide slot. Preferably the second guiding member is disposed on the movable guard and is offset from the position of connection of the rotating shaft.

The first, second and/or third guiding members may be an elongate fastener (eg an elongate threaded fastener). In a preferred embodiment, the first, second and/or third guiding member is a threaded fastener (eg a bolt).

Preferably the first curved slide slot is an arcuate shaped slot.

Preferably the first curved slide slot is a cam shaped slot.

Preferably the first curved slide slot is an arcuate shaped groove.

Preferably the first curved slide slot is a cam shaped groove.

Preferably the first curved slide slot protrudes towards the rear side of the power miter saw.

Preferably the third slide slot is an elongated slot.

Preferably the third slide slot is an elongated groove.

In a preferred embodiment, the power miter saw further comprises:

a restoring member surrounding the rotating shaft and accommodated in a cavity in the movable guard so as to give the movable guard a tendency to rotate away from its open position (eg towards a closed position). This tendency may urge the second guiding member to the foremost position of the second slide slot. Preferably the restoring member is a spiral spring.

DESCRIPTION OF THE PREFERRED EMBODIMENTS

Figure 1:
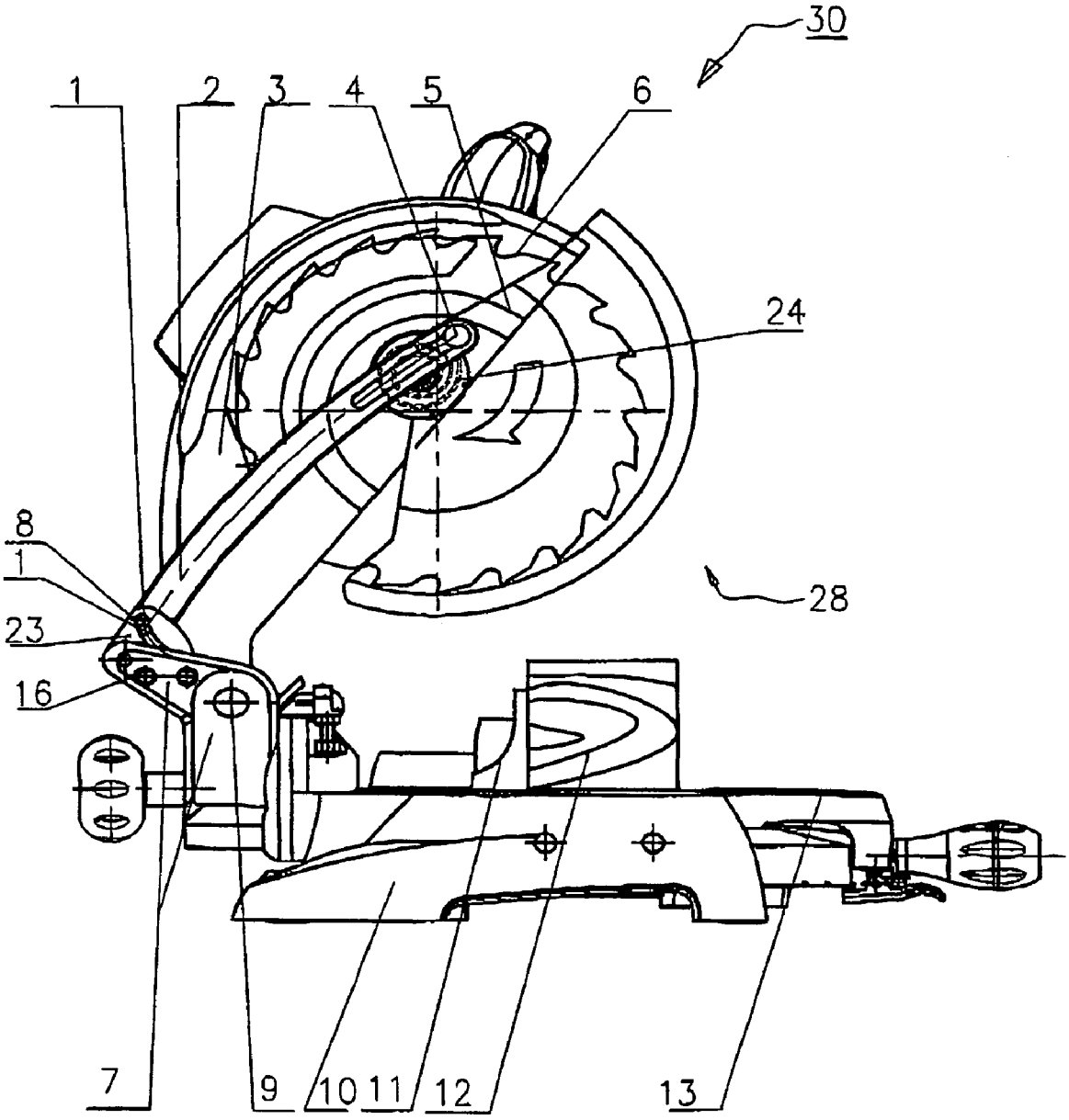
FIG. 1 is a front view of an embodiment of the present invention with the fixed guard in its upper at rest position.
Figure 2:
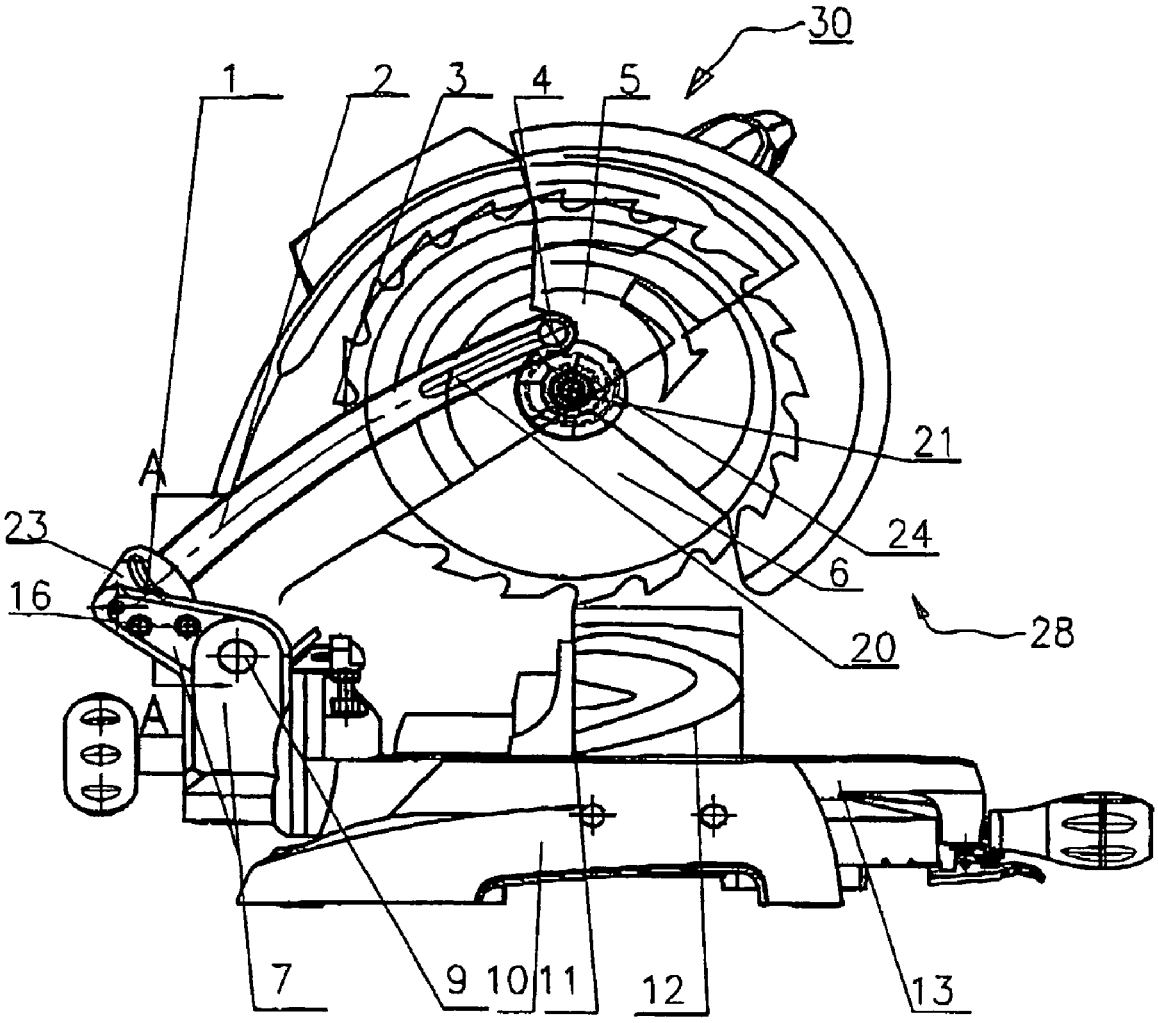
FIG. 2 is a front view of the embodiment of the present invention with the fixed guard pressed down a small distance from the position shown in FIG. 1.
Figure 3:
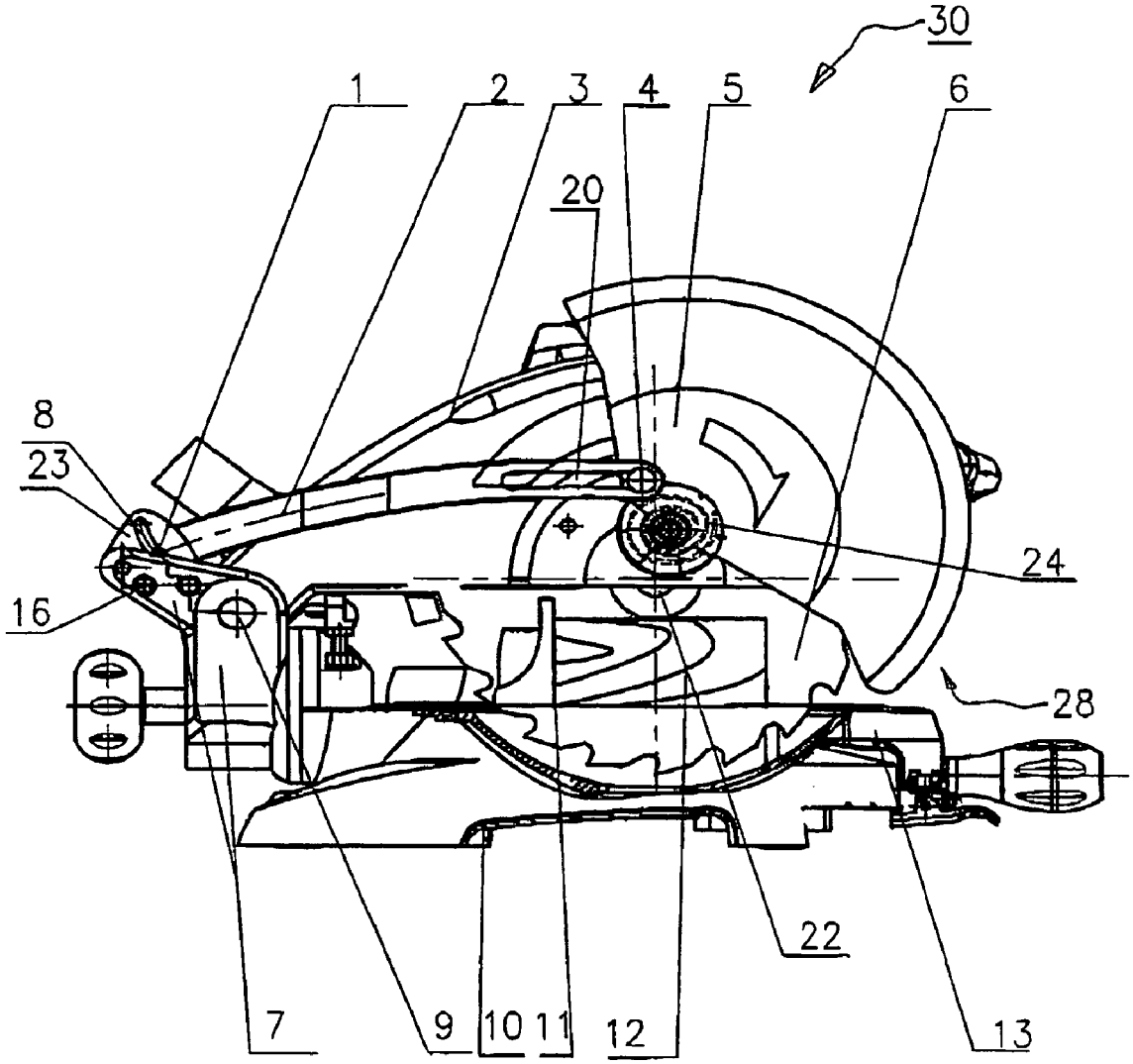
FIG. 3 is a front view of the embodiment of the present invention with the fixed guard in its lower cutting position.
Figure 4:
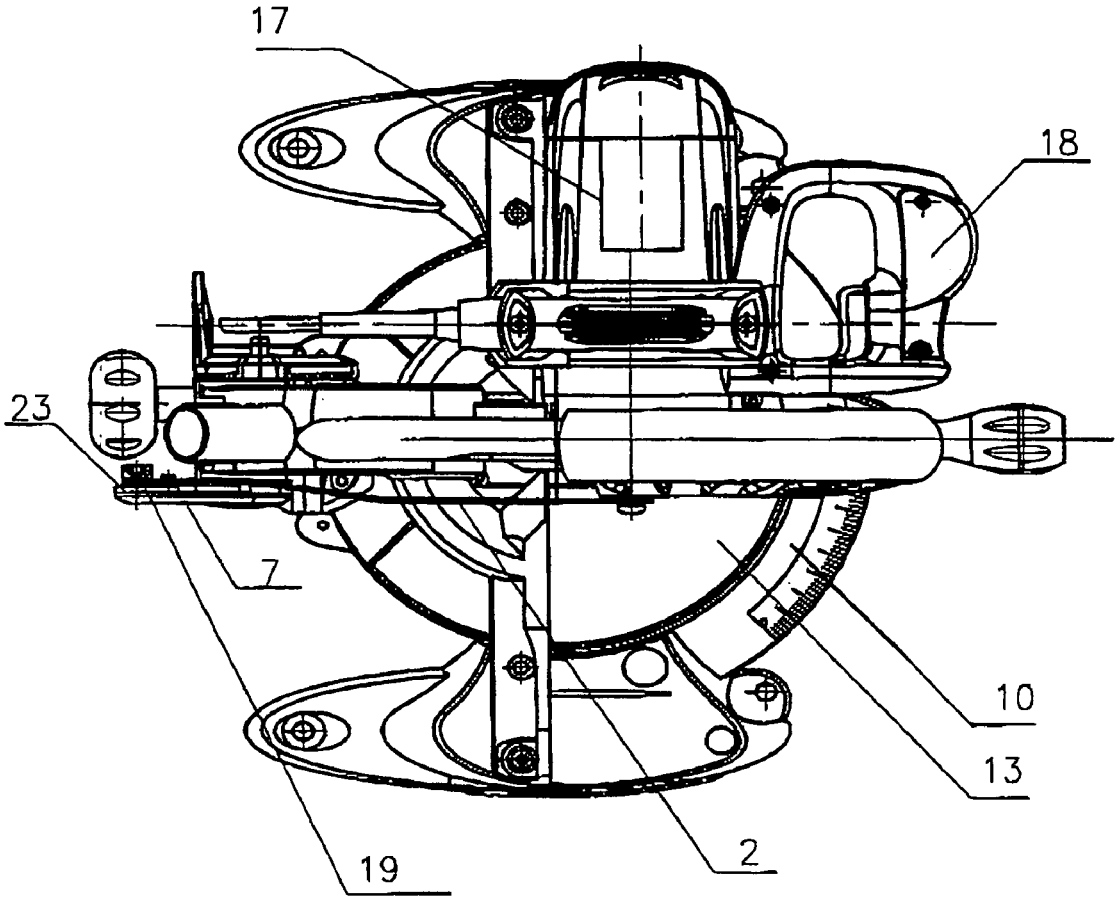
FIG. 4 is a top view of the present invention.
Figure 7:
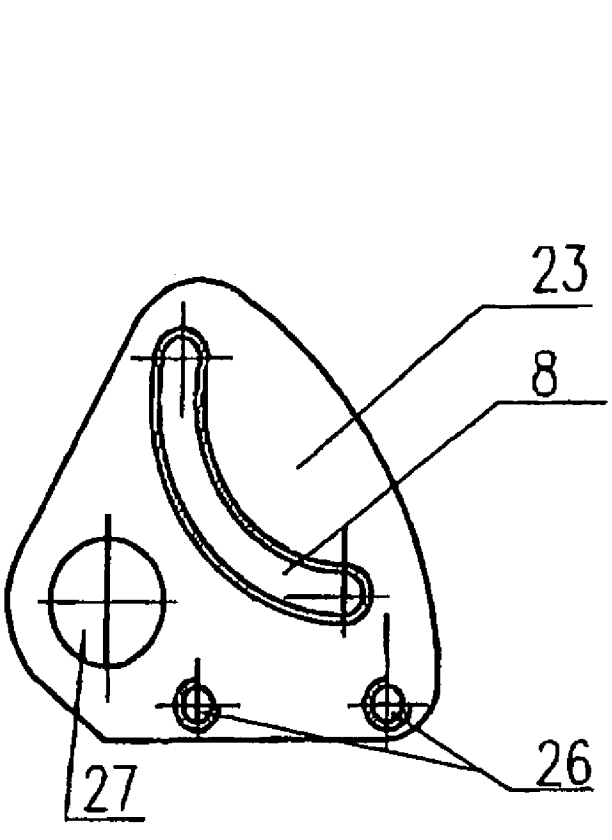
FIG. 7 is a partly enlarged view of the member connected to the mounting arm of the embodiment to show the first arcuate slide slot.
Figure 6:
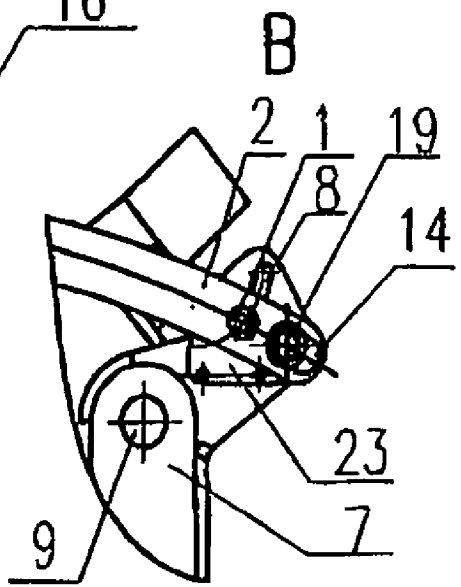
FIG. 6 is a view taken from direction B of the FIG. 5.
Figure 5:
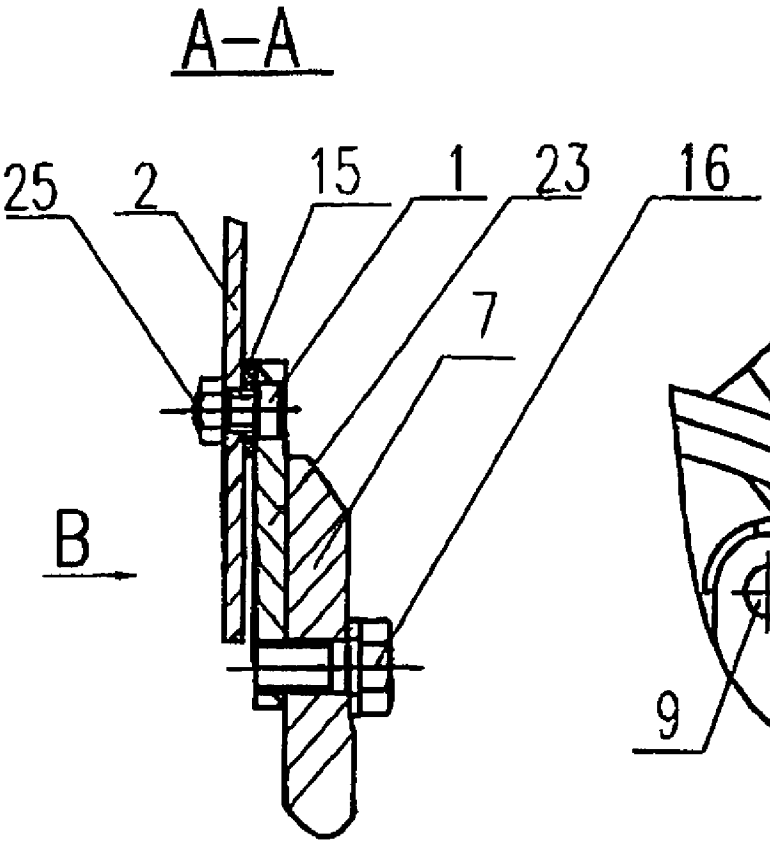
FIG. 5 is a sectional view taken along line A—A of FIG. 2.

Referring to the embodiment illustrated in FIGS. 1 to 7, a power (or compound) miter saw 30 includes a rotatable saw unit 28 with a circular saw blade 6 which is rotatably mounted within a fixed guard 3 on an output rotating shaft 22 of a drive means which is driven by an electric motor 17. A handle 18 for raising and lowering the rotatable saw unit 28 between an upper (at rest) and lower (operational or full cut) position is mounted to the front (or operator) side of the power miter saw 30. A turntable 13 is rotatably mounted within a support base 10. A fence 11 is supported on the turntable 13 for stabilizing and supporting a workpiece 12.

The power miter saw 30 further includes a quick actuating mechanism for opening a movable guard 5 in response to movement of the rotatable saw unit 28 from the upper to the lower position. On opening the movable guard 5, the circular saw blade 6 is exposed for cutting. The quick actuating mechanism comprises a mounting arm 7 mounted substantially vertically on the support base 10. The fixed guard 3 is pivotally connected to the mounting arm 7 by a rotating shaft 9. An actuating link 2 couples the mounting arm 7 and the movable guard 5. The movable guard 5 is pivotally connected to the fixed guard 3 by a rotating shaft 21 and is pivotally connected to a front end of the actuating link 2 by a second guiding member in the form of a bolt 4. The bolt 4 is disposed on the movable guard 5 and is in an offset position relative to the rotating shaft 21. The bolt 4 engages a second slide slot 20 which is formed on (and extends substantially in the longitudinal direction of) the front end of the actuating link 2. The second slide slot 20 enables the operator to manually upwardly rotate the movable guard 5 when the circular saw blade 6 needs to be replaced.

A spiral spring 24 surrounds the rotating shaft 21 and is accommodated in a cavity formed on the movable guard 5 for storing energy during opening of the movable guard 5 thereby giving the movable guard 5 a tendency to rotate back to its closed position in which it covers the circular saw blade 6. This tendency urges the bolt 4 to the front most position of the second slide slot 20.

The rear end of the actuating link 2 is pivotally connected to the mounting arm 7 by a first guiding member in the form of a bolt 1. A plate 23 containing a first arcuate slide slot 8 is screwed to the mounting arm 7 by connecting bolts 16 passing through two bolt holes 26. One end of the bolt 1 passes through the first arcuate slide slot 8 and is secured to the plate 23 and the other end is secured by a nut 25 to the face of the actuating link 2. A washer 15 is disposed between the actuating link 2 and the plate 23 for preventing undesirable frictional contact therebetween. The shape of the first arcuate slide slot 8 protrudes toward the rear side of the power miter saw 30 and determines that the movable guard (5) moves substantially radially outwardly.

The rear end of the actuating link 2 is movably connected to the plate 23 by a third guiding member 19. The third guiding member 19 passes through a hole 27 formed on the plate 23 and is fastened to the mounting arm 7. The third guiding member 19 engages a third slide slot 14 extending substantially along the longitudinal axis of the rear end of the actuating link 2 and moves along the third slide slot 14 relative to the actuating link 2 when the fixed guard 3 is pressed downwards so that the movable guard (5) moves substantially radially outwardly.

We claim:

1. A power miter saw comprising:

a support base;

a mounting arm connected to the support base;

a fixed guard pivotally connected to the mounting arm by a first rotating shaft, the fixed guard being pivotal about the rotating shaft between an upper at rest position and a lower cutting position;

a drive means having an output rotating shaft;

a circular saw blade fixed to the output rotating shaft and mounted within the fixed guard;

a movable guard rotatably connected to the fixed guard by a second rotating shaft;

an actuating link for linking the mounting arm with the movable guard, wherein the front end of the actuating link is connected to the movable guard causing the movable guard to be rotatably openable to expose the circular saw blade for cutting in response to movement of the fixed guard from the upper at rest position to the lower cutting position characterized in that the power miter saw further comprises:

a first guide coupling between the rear end of the actuating link and the mounting arm, wherein the first guide coupling guides the rear end of the actuating link in an arcuate direction relative to the mounting arm in response to movement of the fixed guard from the upper at rest position to the lower cutting position such that the movable guard moves substantially outwardly; and a third guide coupling between the rear end of the actuating link and the mounting arm, wherein the third guide coupling guides the rear end of the actuating link in a direction relative to the mounting arm which is substantially along its longitudinal axis in response to movement of the fixed guard from the upper at rest position to the lower cutting position.

2. A power miter saw as claimed in claim 1 further comprising:

a member connected to the mounting arm, wherein the first guide coupling comprises:

a first guiding member disposed on the rear end of the actuating link and a first curved slide slot formed in the member and wherein the third guide coupling comprises:

a third guiding member connected to the member and a third slide slot formed in the rear end of the actuating link, whereby the movement of the rear end of the actuating link relative to the mounting arm is guided by the first guiding member engaging the first curved slide slot and the third guiding member engaging the third slide slot.

3. A power miter saw as claimed in claim 1, wherein a second slide slot is formed in the front end of the actuating link and extends in a substantially longitudinal direction therealong, wherein a second guiding member engages the second slide slot.

4. A power miter saw as claimed in claim 2, wherein the first curved slide slot is an arcuate shaped slot.

5. A power miter saw as claimed in claim 2, wherein the first curved slide slot is a cam shaped slot.

6. A power miter saw as claimed in claim 2, wherein the first curved slide slot protrudes towards the rear side of the power miter saw.

7. A power miter saw as claimed in claim 2, wherein the third slide slot is an elongated slot.

8. A power miter saw comprising:

a support base;

a mounting arm connected to the support base;

a fixed guard pivotally connected to the mounting arm by a rotating shaft;

a drive means; and a circular saw blade fixedly connected to the output rotating shaft of the drive means;

a movable guard pivotally connected to the fixed guard by a rotating shaft of the movable guard, wherein the movable guard is pivotally connected to a front end of an actuating link;

characterized in that:

a member is connected to the mounting arm, a first curved slide slot is formed on the member and a third guiding member connects to the member;

a first guiding member is disposed on the rear end of the actuating link and a third slide slot formed on the rear end of the actuating link;

whereby the rear end of the actuating link is movably connected to the member by the first guiding member engaging the first curved slide slot and the third guiding member engaging the third slide slot.

* * * * *